US007213562B2

(12) United States Patent
Schnaitmann

(10) Patent No.: US 7,213,562 B2
(45) Date of Patent: May 8, 2007

(54) PISTON FOR A COMBUSTION ENGINE AND CASTING METHOD FOR THE PRODUCTION THEREOF

(75) Inventor: Gottfried Schnaitmann, Backnang (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/559,884

(22) PCT Filed: Jun. 7, 2004

(86) PCT No.: PCT/DE2004/001151

§ 371 (c)(1),
(2), (4) Date: Jan. 20, 2006

(87) PCT Pub. No.: WO2004/111419

PCT Pub. Date: Dec. 23, 2004

(65) Prior Publication Data

US 2006/0118076 A1 Jun. 8, 2006

(30) Foreign Application Priority Data

Jun. 7, 2003 (DE) ..... 103 25 917

(51) Int. Cl.
*F02F 3/20* (2006.01)

(52) U.S. Cl. ..... 123/193.6; 123/41.35; 164/132; 29/888.047

(58) Field of Classification Search ..... 164/30, 164/31, 98, 132, 340, 341, 345, 346; 123/193.6, 123/41.35; 29/888.04, 888.042, 888.047; 92/172

See application file for complete search history.

(56) References Cited

U.S. PATENT DOCUMENTS 3,459,253 A * 8/1969 Woolcott ..... 164/36

(Continued)

FOREIGN PATENT DOCUMENTS

DE 2106923 11/1971

(Continued)

OTHER PUBLICATIONS

International Search Report.

*Primary Examiner*—Marguerite McMahon
(74) *Attorney, Agent, or Firm*—Collard & Roe, P.C.

(57) ABSTRACT

The invention relates to a piston (1), which is comprised of an approximately circular cylindrical upper area (5) and of a lower area (6), having two hubs (7), which are set back toward the piston central axis (8) so that, in the upper area (5), recesses (12, 12') can be made, which are open toward the lower area (6), in the vicinity of the hubs (7). In order to make relief cuts (13, 13') in the area between the hubs (7) and the upper area (5), a salt mold part (15) is placed on the respective window insert (14). The salt mold part (15) serves to produce the recesses (12, 12') as well as the relief cuts (13, 13') when casting the piston (1) and is washed out after the piston (1) has been cast.

3 Claims, 2 Drawing Sheets

U.S. PATENT DOCUMENTS

Figure 1:
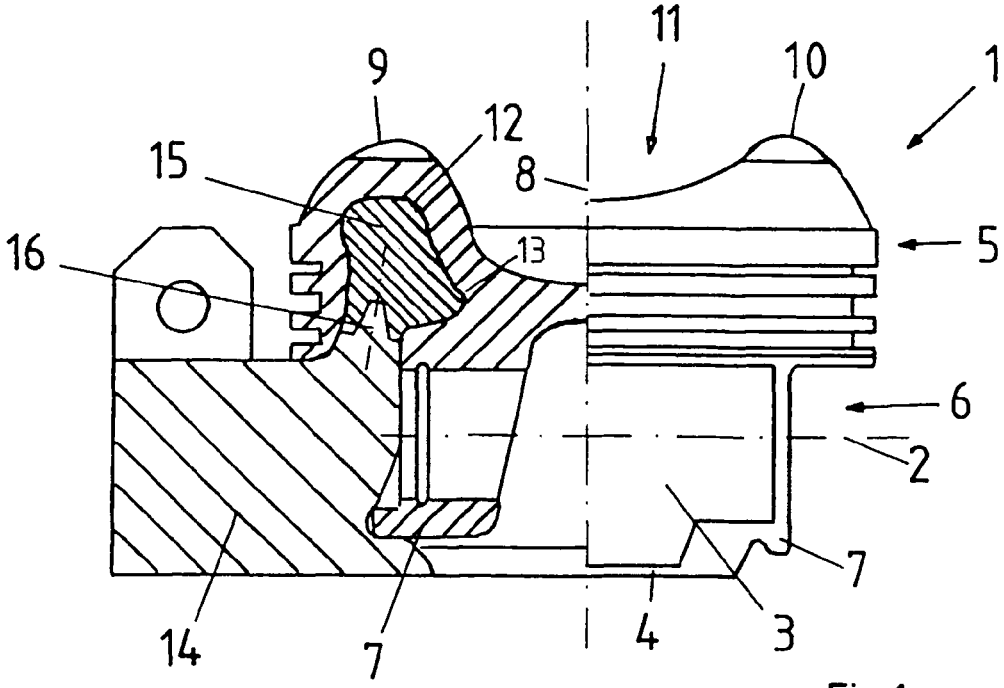

| | | | | | |
|---|---|---|---|---|---|
| 4,577,595 | A | | 3/1986 | Deutschmann et al. | |
| 4,651,631 | A | * | 3/1987 | Avezou | 92/224 |
| 4,776,075 | A | * | 10/1988 | Kawabata et al. | 29/888.047 |
| 4,891,875 | A | * | 1/1990 | Soichi et al. | 29/888.046 |
| 5,692,430 | A | | 12/1997 | McLaughlin et al. | |
| 5,737,838 | A | * | 4/1998 | Niimi et al. | 29/888.047 |
| 5,794,582 | A | * | 8/1998 | Horiuchi | 123/197.2 |
| 5,979,298 | A | * | 11/1999 | Whitacre | 92/211 |
| 6,546,993 | B1 | * | 4/2003 | Tilch | 164/132 |

FOREIGN PATENT DOCUMENTS

| | | |
|---|---|---|
| DE | 2923330 | 1/1980 |
| DE | 34245228 | 2/1986 |
| DE | 4434994 | 4/1996 |
| DE | 10003821 | 1/2000 |
| DE | 19922809 | 11/2000 |
| DE | 10013395 | 8/2001 |
| DE | 10142980 | 3/2003 |
| EP | 0027445 | 7/1983 |
| EP | 0364810 | 10/1989 |
| GB | 617224 | 8/1946 |
| WO | WO99/23380 | 5/1999 |

* cited by examiner

PISTON FOR A COMBUSTION ENGINE AND CASTING METHOD FOR THE PRODUCTION THEREOF

CROSS REFERENCE TO RELATED APPLICATIONS

Applicant claims priority under 35 U.S.C. 119 of German Patent Application No. 103 25 917.1 filed Jun. 7, 2003. Applicant also claims priority under 35 U.S.C. §365 of PCT/DE2004/001151 filed Jun. 7, 2004.

The invention relates to a piston for an internal combustion engine in accordance with the preamble of claim 1, and a method for its production, in accordance with the preamble of claim 2.

A piston is known from the Offenlegungsschrift DE 199 22 809 A1, having pin bosses molded onto a cylindrically configured upper region of the piston, which are recessed as compared with the edge of the upper region, so that when the piston is cast, recesses can be formed in the underside of the overhang formed thereby, close to the pin bosses. For this purpose, a casting mold is used that contains a pivoting window insert having one casting core per recess, but this can only produce those recesses from which the casting core can easily be pulled out after casting. This has the disadvantage that in this way, the weight of the upper region of the piston cannot be reduced to such an extent that the center of gravity of the piston can be displaced as far as possible into the lower region of the piston, to achieve problem-free engine operation.

It is known from Offenlegungsschrift DE 101 42 980 A1 to set a mold body onto a casting tool that can be displaced at a slant to the piston axis, which can be used to produce a recess under the head of the piston, behind its ring field, when the piston is cast, which recess has a nose-shaped undercut that points in the direction of the piston axis. After the piston is cast, the casting tool is pulled away from the piston, towards the bottom, at a slant, whereby the mold body remains in the piston for a short time, before it is washed out.

It is a disadvantage in this connection that a very complicated mechanism is required to hold the casting tool precisely in the intended position during casting of the piston, and to move it away from the piston at a downward slant after casting, to pull it out of the mold body. Furthermore, the mold part known from the state of the art does not have any indentations that allow production of ribs in the recess, and this brings with it the additional disadvantage that the piston known from the last prior art reference has only a low mechanical strength.

A piston having a combustion chamber bowl in the piston head is known from the European patent application EP 0 364 810 A2, the underside of which is connected with pin bosses by way of ridges. In the region of the piston head and radially outward, the piston furthermore has a recess that is open downward, in the form of a cooling channel, the radially inner region of which is divided by the ridges. However, since the ridges do not reach to the belt that delimits the recess radially on the outside, there is the disadvantage that the mechanical strength of the region on the piston head side of the piston known from the EP application is very low.

Proceeding from this, the invention is based on the task of avoiding the disadvantages of the cited prior art. This task is accomplished with the characteristics found in the characterizing parts of the main claim and of the ancillary claim. A practical embodiment of the invention is the object of the dependent claim.

In this connection, the advantages of a pivoting window insert with which recesses can be produced in simple manner, in terms of casting technology, for which slides that can be moved in linear manner are unsuitable, are combined with the advantages of a salt core, which offers an unlimited potential of possibilities of configuring cavities in pistons.

Figure 2:
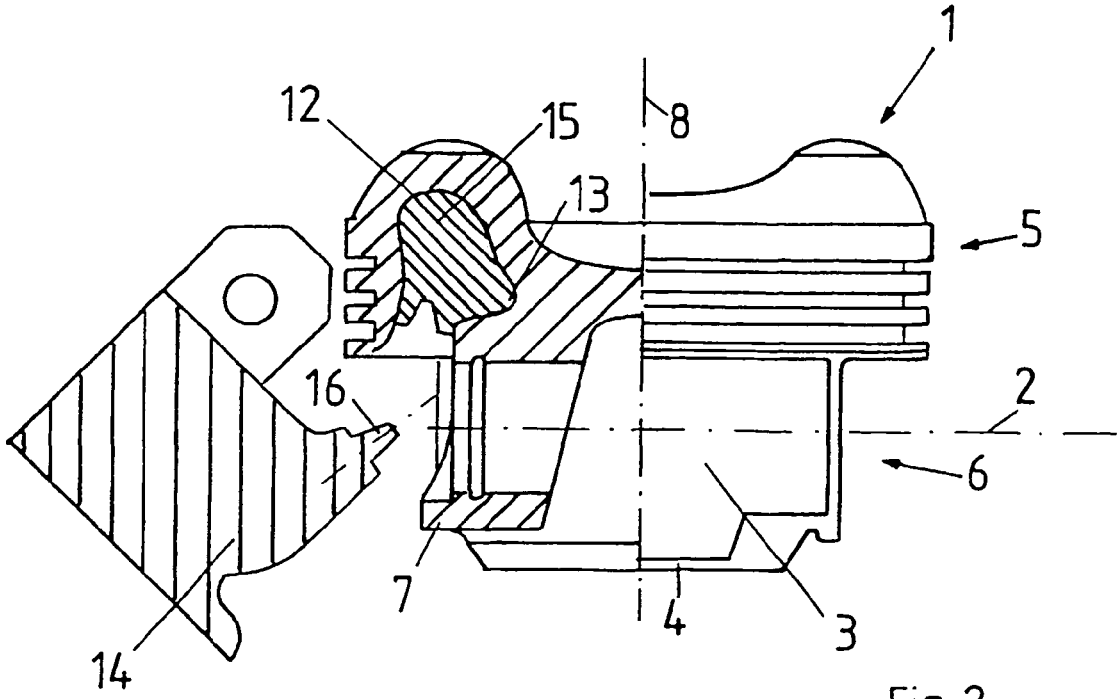

An exemplary embodiment of the invention will be described below, using the drawings. These show:

FIG. 1 a piston in partial cross-section, after casting, with the salt mold part inserted, attached to a pivoting window insert, FIG. 2 the piston with the salt mold part inserted, and the window insert, which has come loose from the salt mold part, pivoted out, FIG. 3 the piston in partial cross-section, after the salt mold part has been washed out, and FIG. 4 a view of the piston according to the invention from below.

In FIG. 1, a piston 1 is shown in half cross-section, the left half of which shows a cross-section of the piston lying on the longitudinal axis 2 of a piston pin, not shown, and the right half of which shows a side view of the piston 1, in which a coated region 3 of a piston skirt 4 can be seen. The piston 1 is configured as a box-type piston, i.e. a lower region 6 that has an approximately box-shaped cross-section is located below an upper region 5 in the shape of a circular cylinder, which accommodates the piston rings; in the former, the bosses 7 and the box walls in the region of the bosses 7 are drawn in towards the central piston axis 8, and only the skirt wall sections that lie in the region of the major thrust side and the minor thrust side have the shape, in cross-section, of segments of a circle whose diameter corresponds to the piston diameter.

The piston 1 has two raised regions 9 and 10, which are disposed on the two sides of a combustion chamber bowl 11 molded into the piston head. To ensure that these raised regions 9 and 10 do not displace the center of gravity of the piston 1 too far upward in the direction of the combustion chamber bowl 11, during casting of the piston 1, recesses 12 that are open towards the lower region 6 of the piston 1 are formed in the combustion chamber bowls 9, 10, and furthermore undercuts 13 are formed in the region between the bosses 7 and the upper region 5, which are configured to be nose-shaped in the present exemplary embodiment and are oriented towards the central piston axis 8, in each instance, but which can also have a different shape that is suitable for reducing the weight of the piston. Furthermore, the center of gravity of the piston 1 is moved in the direction of the bosses 7 by means of the material that is saved in this connection.

Here, the casting mold for casting the piston 1 has a pivoting window insert 14 for each of the recesses 12 to be produced in the two raised regions 9 and 10. In order to be able to mold the undercuts 13 in the upper region 5 of the piston 1 with this insert, a pre-finished salt mold part 15 is applied to the window insert 14 before the piston 1 is cast; the shape of this mold part is identical with the shape of the recess 12, including the undercut 13. The salt mold part 15 is attached to the window insert 14, so as not to rotate, by way of two cone-shaped extensions 16 that are disposed on the window insert 14 onto which the salt mold part 15 is set. In FIGS. 1 and 2, the window insert 14 is shown in cross-section, and for this reason only one of the two extensions 16 can be seen. The piston blank 1 is cast with the window insert 14 pivoted in and the salt mold part 15 attached to it.

Subsequent to the casting process, according to FIG. 2, the window insert 14 is pivoted clockwise, at the same time as the rest of the casting mold, not shown in the figures, is opened, whereby the salt mold part 15 is released from the window insert 14 and remains in the piston blank 1, in order to subsequently be washed out.

Figure 3:
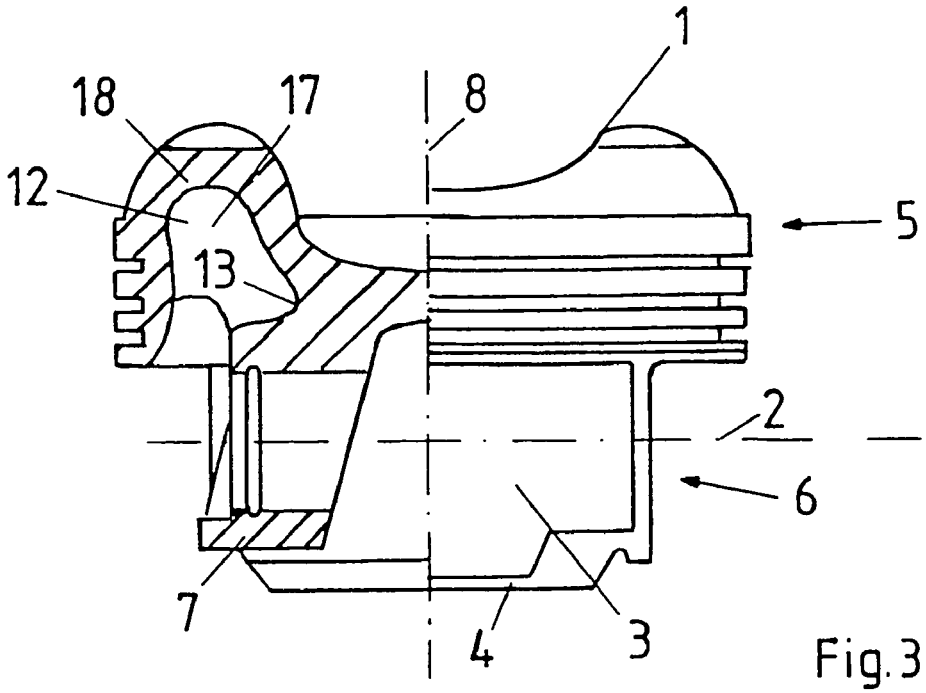
Figure 4:
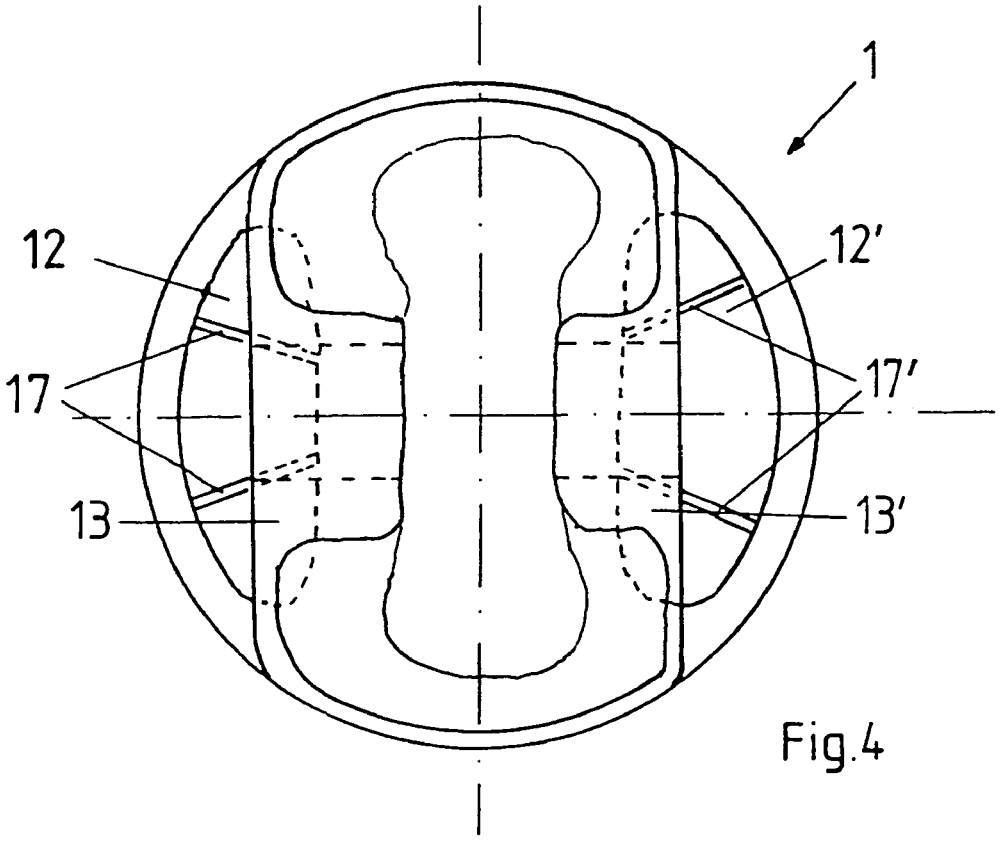

In this connection, the piston blank 1 shown in FIG. 3 is formed, which has the recesses 12 with the undercuts 13, whereby these recesses 12, as also shown in FIG. 4, are divided by ribs 17, 17', which serve to improve the shape stability of the walls 18 of the raised regions 9 and 10. This allows configuring the walls 18 to be very thin, in order to thereby achieve improved cooling of the upper region 5 of the piston 1 by means of spraying it with cooling oil.

The view of the piston from below, according to FIG. 4, shows the kidney-shaped configuration of the recesses 12, 12', with the undercuts 13, 13' shown with broken lines, which undercuts are divided by two ribs 17, 17', in each instance, in the present exemplary embodiment. In the production of the salt mold part 15 used here, the shape and the arrangement of the ribs 17, 17' can be taken into consideration in simple manner, by means of a corresponding configuration of the salt mold part 15. In the exemplary embodiment shown, the shape of the salt mold part 15 corresponds to the negative mold of the recesses 12, 12' and the undercuts 13, 13'. In this connection, FIGS. 1 and 2 show cross-sectional representations of the salt mold part 15, which is configured in one piece and has indentations for forming the ribs 17, 17' shown in FIGS. 3 and 4, which indentations correspond in their shape and depth to the ribs 17 according to FIG. 3, and the arrangement of which corresponds to the arrangement of the ribs 17, 17' according to FIG. 4.

REFERENCE SYMBOL LIST

1 piston, piston blank
2 piston axis
3 coated region
4 piston skirt
5 upper region
6 lower region
7 boss
8 central piston axis
9 lateral raised region
10 lateral raised region
11 combustion chamber bowl
12, 12' recess
13, 13' undercut
14 window insert
15 salt mold part
16 cone-shaped extension
17, 17' ribs
18 wall

The invention claimed is:

1. A casting method for the production of a piston, in which a casting mold having a pivoting window insert for the production of recesses is used, comprising the following method steps:

producing salt mold parts that form the recesses and undercuts that project into a region between bosses of the piston and an upper region of the piston;

introducing indentations in the salt mold parts for producing ribs in the recesses and the undercuts during casting of the piston;

attaching the salt mold parts to each of the window inserts;

casting the piston;

pivoting away the window inserts from the cast piston, so that the salt mold parts are released from the window inserts and remain in the piston; and washing out of the salt mold parts from the piston.

2. A casting method according to claim 1, wherein the window inserts have at least two cone-shaped extensions onto which each of the salt mold parts are set.

3. A piston for an internal combustion engine, said piston being formed by a casting mold having a pivoting window insert for the production of recesses, the piston being made with the following steps:

producing salt mold parts that form the recesses and undercuts that project into a region between bosses of the piston and an upper region of the piston;

introducing indentations in the salt mold parts for producing ribs in the recesses and the undercuts during casting of the piston;

attaching the salt mold parts to each of the window inserts;

casting the piston;

pivoting away the window inserts from the cast piston, so that the salt mold parts are released from the window inserts and remain in the piston; and washing out of the salt mold parts from the piston.

* * * * *